US007867047B2

(12) United States Patent
Sakamoto

(10) Patent No.: US 7,867,047 B2
(45) Date of Patent: Jan. 11, 2011

(54) OUTBOARD MOTOR INTAKE PORT SYSTEM

(75) Inventor: Koji Sakamoto, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 151 days.

(21) Appl. No.: 12/362,900

(22) Filed: Jan. 30, 2009

(65) Prior Publication Data

US 2009/0197488 A1 Aug. 6, 2009

(30) Foreign Application Priority Data

Feb. 1, 2008 (JP) ..... 2008-022998

(51) Int. Cl.
*B63B 35/73* (2006.01)

(52) U.S. Cl. ..... 440/77; 440/88 A

(58) Field of Classification Search ..... 440/77, 440/88 A

See application file for complete search history.

(56) References Cited

U.S. PATENT DOCUMENTS 4,571,193 A * 2/1986 Takada et al. ..... 440/77
6,099,371 A * 8/2000 Nozawa et al. ..... 440/77
6,287,161 B1 * 9/2001 Nozawa ..... 440/77
6,413,131 B1 * 7/2002 Phillips et al. ..... 440/88 R
6,932,662 B1 * 8/2005 Walczak ..... 440/77
7,455,560 B2 * 11/2008 Arai et al. ..... 440/77
2006/0258235 A1 * 11/2006 Kimura et al. ..... 440/77
2007/0093151 A1 * 4/2007 Sanschagrin et al. ..... 440/77

FOREIGN PATENT DOCUMENTS

JP 10-8985 A 1/1998
JP 2007-22423 A 2/2007

* cited by examiner

*Primary Examiner*—Stephen Avila
(74) *Attorney, Agent, or Firm*—Arent Fox LLP

(57) ABSTRACT

An outboard motor intake port system includes an internal cover mounted, from the inside, on an engine cover to form an intake chamber between the internal cover and the engine cover. The internal cover is integrally provided with a bottom plate portion facing the inner face of an upper part of the engine cover, a front wall portion extending upward from a front edge of the bottom plate portion and connected to the inner face of the upper part of the engine cover, and a pair of tubular portions extending upward from the bottom plate portion. The pair of tubular portions are arranged side by side so water that has entered the intake chamber via an intake port passes through the tubular portions. A pair of drain holes for discharging water are formed in the engine cover and communicate with the left and right front parts of the intake chamber.

8 Claims, 6 Drawing Sheets

OUTBOARD MOTOR INTAKE PORT SYSTEM

CROSS-REFERENCE TO RELATED APPLICATION

This application claims the priority of Japan Application No. 2008-22998, filed Feb. 1, 2008, the entire specifications, claims and drawings of which are incorporated herewith by reference.

BACKGROUND OF THE INVENTION

1. Field of the Invention

The present invention relates to an outboard motor intake port system including a vertically extending casing that is adapted to be supported on a hull; an engine mounted on an upper part of the casing; an engine cover covering the engine and having, in an upper part thereof, an intake port opening on a rear side; and an intake chamber formed within the engine cover, the intake chamber being disposed above the engine and communicating with the intake port.

2. Description of the Related Art

Japanese Patent Application Laid-open No. 2007-22423 and Japanese Patent Application Laid-open No. 10-8985 disclose a conventional outboard motor intake port system.

The arrangement of the components for the conventional outboard motor intake port system disclosed by Japanese Patent Application Laid-open No. 2007-22423 and Japanese Patent Application Laid-open No. 10-8985 prevents water that has entered an intake chamber due to turbulent waters from entering an engine compartment. Such an objective is achieved by vertically extending an engine compartment by forming an upper end of a tubular portion with a passage hole that provides communication between the intake chamber and the engine compartment, wherein the hole is formed near an inner face of an upper part of an engine cover. However, when a relatively large amount of water enters the intake chamber, it is difficult to prevent such water from entering the engine compartment therefrom.

SUMMARY OF THE INVENTION

The present invention has been accomplished in view of circumstances mentioned above, and it is an aspect thereof to provide an outboard motor intake port system that prevents water from entering an engine compartment using a relatively simple structure, even when a relatively large amount of water has entered the intake chamber.

In order to at least achieve the above-discussed aspect and other aspects, according to a first feature of the present invention, an outboard motor intake port system includes a vertically extending casing that is adapted to be supported on a hull; an engine mounted on an upper part of the casing; an engine cover covering the engine and having, in an upper part thereof, an intake port opening on a rear side; and an intake chamber formed within the engine cover. The intake chamber is disposed above the engine and communicates with the intake port. The intake chamber includes the engine cover and an internal cover, which is mounted to an interior surface of the engine cover to segregate or separate the intake chamber from an engine compartment housing the engine. The internal cover integrally includes a bottom plate portion facing an inner face of the upper part of the engine cover and having a rear edge part and two side edge parts connected to the inner face of the upper part of the engine cover; a front wall portion extending upward from the front edge of the bottom plate portion and being connected to the inner face of the upper part of the engine cover; and a pair of tubular portions extending upward from the bottom plate portion while forming passage holes which provide communication between the intake chamber and the interior of the engine compartment. The two tubular portions are arranged side by side in the left-to-right direction wherein any water that has entered the intake chamber via the intake port passes through the two tubular portions. A pair of drain holes for discharging water therefrom is defined in the engine cover and communicates with left and right front wall areas within the intake chamber.

In accordance with the above, water that has entered the intake chamber via the intake port reaches the front wall portion by passing through the pair of tubular portions, branches to the left and right after abutting against the front wall portion, and is discharged from the outboard motor via the two drain holes. As such, even if a relatively large volume of water enters the intake chamber via the intake port at one time, the water is efficiently discharged via the drain holes. Therefore, it is possible to effectively prevent water from entering the engine compartment via the intake chamber. Moreover, it is possible to prevent water from entering the engine compartment by mounting a uniquely configured internal cover to an inner surface of the engine cover.

According to a second feature of the present invention, a width of the intake port in a left-to-right direction is set to be smaller than a distance between outer ends of the two tubular portions in the left-to-right direction.

In accordance with the second feature of the present invention, water that has entered the intake chamber via the intake port is effectively guided between the pair of tubular portions whose distance between the outer ends in the left-to-right direction is set to be larger than the width of the intake port in the left-to-right direction.

According to a third feature of the present invention, the bottom plate portion is formed to incline upward in a direction that is from the intake port toward the front wall portion.

In accordance with the third feature of the present invention, since the bottom plate portion inclines upward from the intake port toward the front wall portion, the discharge of water from the intake chamber is effectively carried out by returning water that has entered the intake chamber to the intake port side.

According to a fourth feature of the present invention, side walls of the two tubular portions facing the intake port are formed in an inclined manner to be closer to each other in a forward direction.

In accordance with the fourth feature of the present invention, since the side walls of the two tubular portions facing the intake port are inclined to be closer to each other, water that has entered the intake chamber via the intake port is effectively guided between the pair of tubular portions.

A mode for carrying out the present invention is explained below by reference to an embodiment of the present invention shown in the attached drawings.

DESCRIPTION OF THE PREFERRED EMBODIMENT

Figure 1:
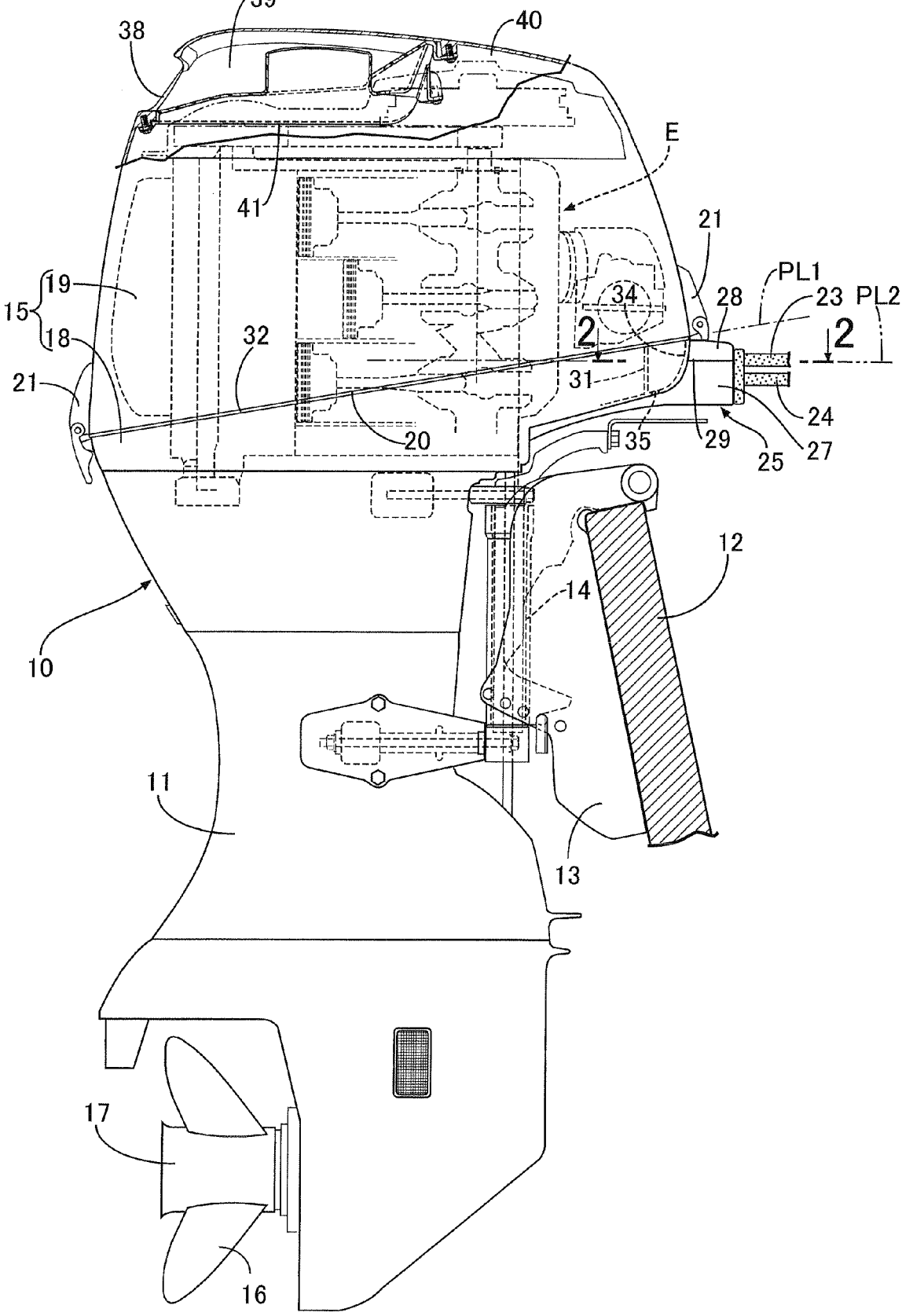
FIG. 1 is a side view of an outboard motor intake port system according to a preferred embodiment of the present invention.

Referring to FIG. 1, an outboard motor 10 includes a stern bracket 13 clamped onto the stern of a hull 12 and a vertically extending casing 11 joined to the stern bracket 13 via a swivel shaft 14 so that the casing 11 can swing in a left-to-right direction. An engine E is mounted on an upper part of the casing 11 and is covered by an engine cover 15. Rotational power produced by the engine E is transmitted to a propeller shaft 17 that is supported on a lower part of the casing 11. A propeller 16 is attached to a rear end part of the propeller shaft 17.

The engine cover 15 is formed from a lower cover 18, which is fixed to the upper part of the casing 11, and an upper cover 19, which is joined to the lower cover 18 via a first mating surface 20. The lower and upper covers 18 and 19 are joined along a first plane PL1 that inclines upward in a forward direction. The lower cover 18 and the upper cover 19 are joined to each other by a plurality of lock levers 21.

Figure 2:
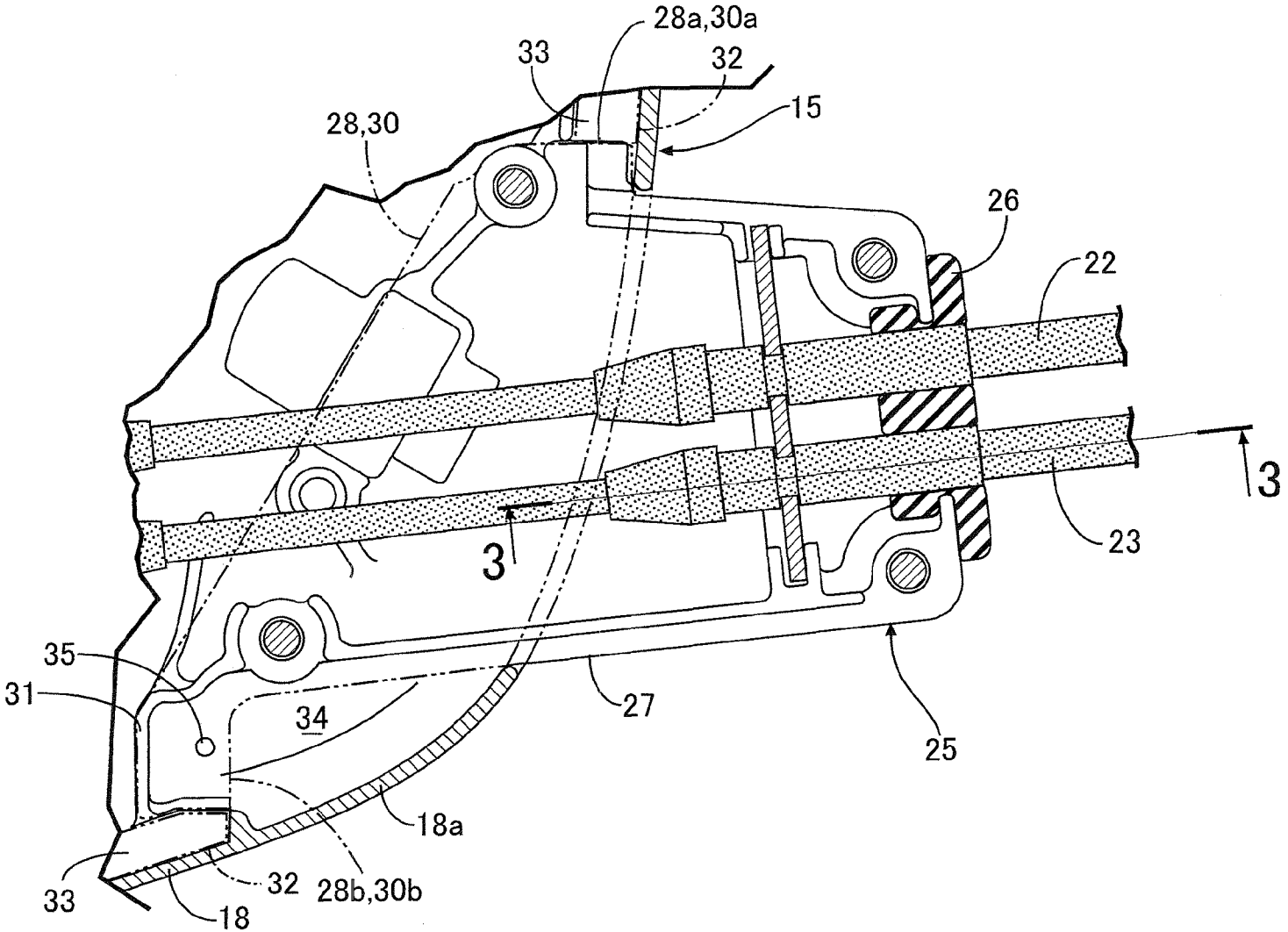
FIG. 2 is an enlarged cross-sectional view taken along line 2-2 in FIG. 1.
Figure 3:
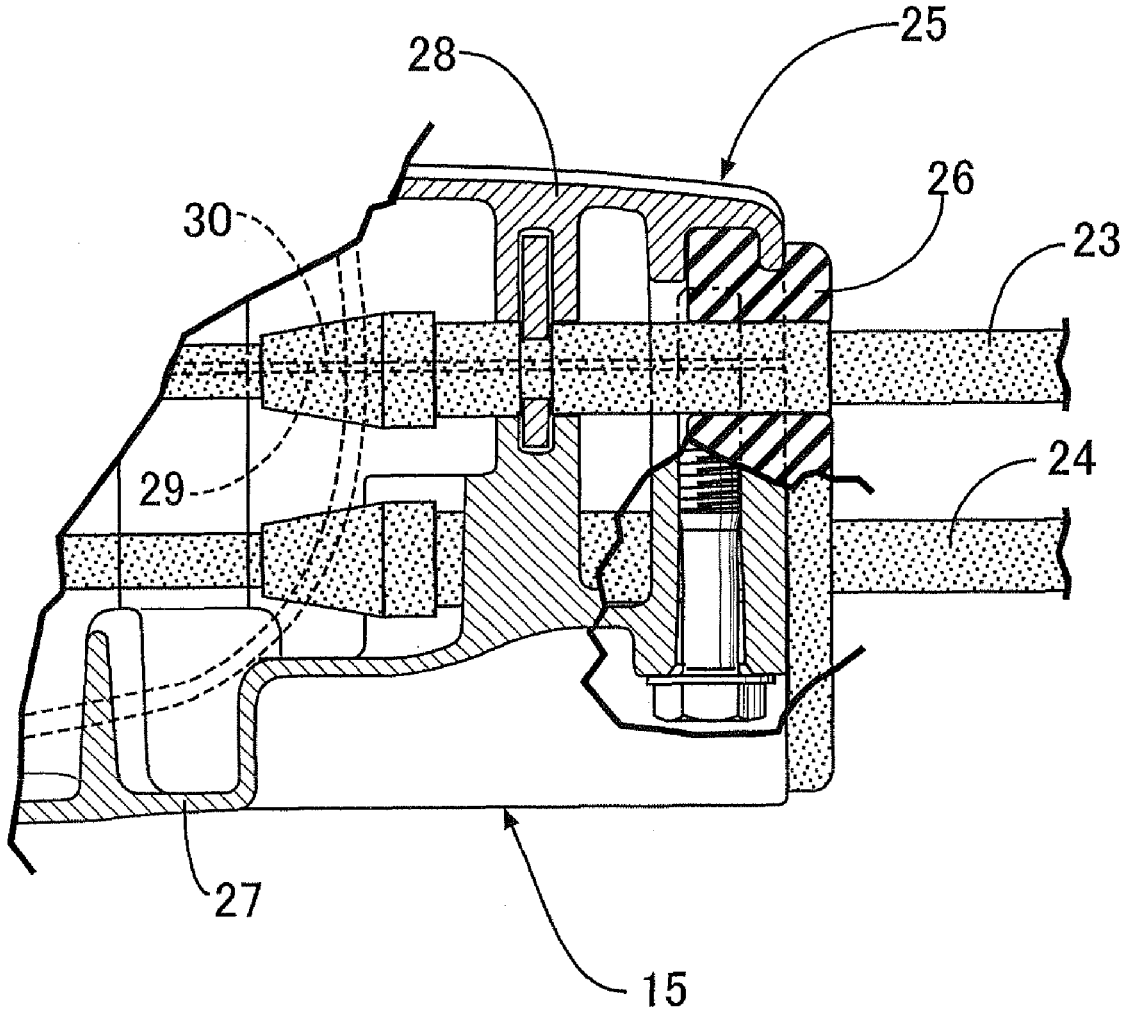
FIG. 3 is a cross-sectional view taken along line 3-3 in FIG. 2.

Referring to FIGS. 2-3, a linear member lead-out part 25 for guiding a linear member, such as, for example, a throttle wire 22, a shift wire 23, an electric wire 24, and the like, from out of the interior of the engine cover 15 projects forward from a front wall of the engine cover 15. The linear member lead-out part 25 is disposed among left and right side walls of the lower cover 18, closer to the right side wall to avoid the lock lever 21 provided between the front walls of the lower cover 18 and the upper cover 19. The throttle wire 22, the shift wire 23, the electric wire 24, and the like, run in a liquid-tight manner through a grommet 26 that is attached to the linear member lead-out part 25 and then guided to the exterior.

The linear member lead-out part 25 is formed from a case part 27 and a lid member 28. The case part 27 is integrally connected to the lower cover 18 and projects forward from the front wall of the lower cover 18. The lid member 28 is joined to the case part 27 via a second mating surface 29 that is disposed below the first mating surface 20. The second mating surface 29 follows a second plane PL2 which obliquely intersects the first plane PL1.

A right side wall of the case part 27 is positioned inward of the right side wall of the lower cover 18. A connecting wall portion 31, which joins the right side wall of the case part 27 and the right side wall of the lower cover 18 at substantially right angles, is integrally provided with the lower cover 18.

The lid member 28 is secured to the case part 27 with a gasket 30 that is configured to correspond to the external shape of the lid member 28 and is disposed between the lid member 28 and the case part 27 (see FIG. 2). The lid member 28 and the gasket 30 are provided with integral first projections 28*a* and 30*a*, respectively, that abut, via the interior, against the front wall of the lower cover 18 on the left-hand side of the linear member lead-out part 25. The lid member 28 and the gasket 30 are also provided with second projections 28*b* and 30*b*, respectively, that project toward the inner face of the right side wall of the lower cover 18 and overlap the connecting wall portion 31 on the right-hand side of the linear member lead-out part 25.

A gasket 32 is mounted between the lower cover 18 and the upper cover 19 in a location that is remote from a location of the linear member lead-out part 25. The gasket 32 is fitted onto the upper cover 19 side, and a flat seal face 33, which contacts the gasket 32, is formed on an upper face of a peripheral wall of the lower cover 18 in a location that is remote from a location of a portion for the case part 27. A seal member, which is not illustrated, is mounted between the upper cover 19 and the lid member 28.

Since the second mating surface 29 is positioned below the first mating surface 20, part of the lid member 28 is located below the first mating surface 20. The seal member is not located in the part between the lid member 28 and the lower cover 18, and even if the lid member 28 abuts against the lower cover 18, it is impossible to prevent a small gap from being formed between the lid member 28 and the lower cover 18.

Since the first projection 28*a* of the lid member 28 abuts, via the interior, against the front wall of the lower cover 18 on the left-hand side of the linear member lead-out part 25, the gap formed between the linear member lead-out part 25 and the engine cover 15 on the left-hand side of the linear member lead-out part 25 has a serpentine shape, and the entrance of water into the engine cover 15 is therefore minimized. On the other hand, since the second projection 28*b* of the lid member 28 abuts, via the interior, against the right side wall of the lower cover 18 on the right-hand side of the linear member lead-out part 25, there is a possibility of water entering the engine cover 15 via a gap formed between the second projection 28*b* of the lid member 28 and the right side wall of the lower cover 18 on the right-hand side of the linear member lead-out part 25.

Because of the above-described situation, the lower cover 18 is integrally provided with an extended wall portion 18*a* that smoothly joins the right side wall of the lower cover 18 and extends close to the linear member lead-out part 25. As such, the extended wall portion 18*a* is disposed in front of the connecting wall portion 31. A water entrance chamber 34 is defined in the lower cover 18 and is disposed on the right-hand side of the linear member lead-out part 25, wherein front and rear walls of the water entrance chamber 34 are defined by the connecting wall portion 31 and the extended wall portion 18*a*, which are spaced in the fore-and-aft direction. Moreover, the lower cover 18 is provided with a drain hole 35 for discharging water from the water entrance chamber 34 and out of the outboard motor to the exterior environment via the drain hole 35 opening defined in a bottom part of the water entrance chamber 34.

Figure 4:
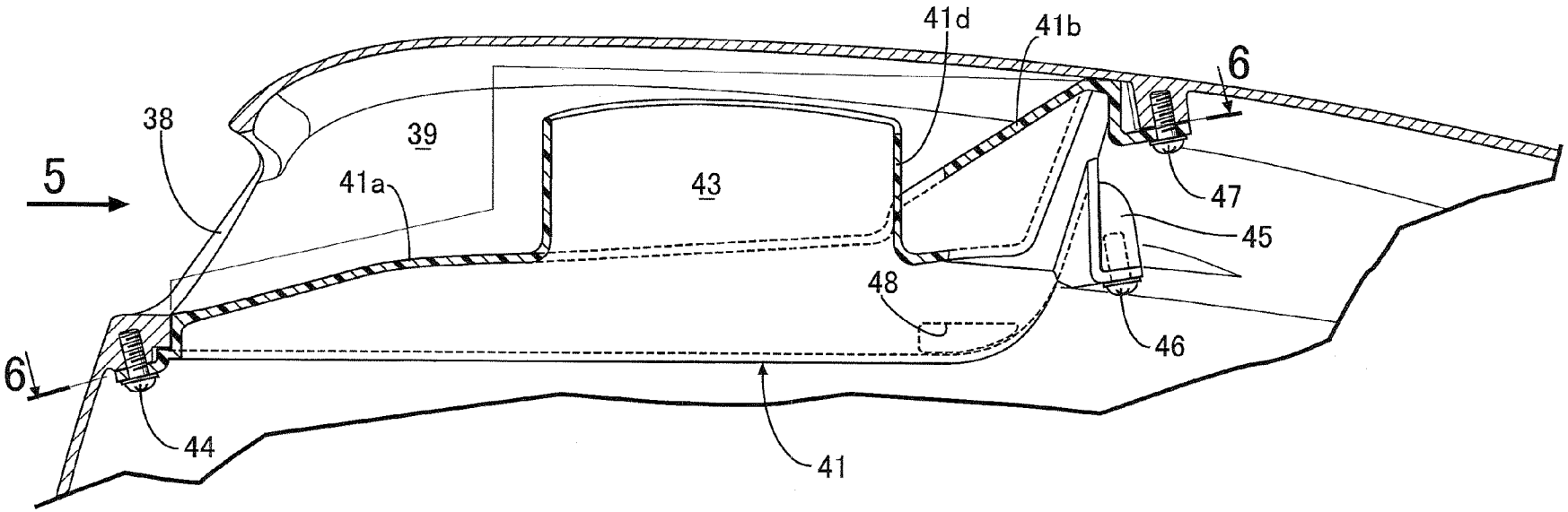
FIG. 4 is an enlarged cross-sectional view taken along line 4-4 in FIG. 6.
Figure 5:
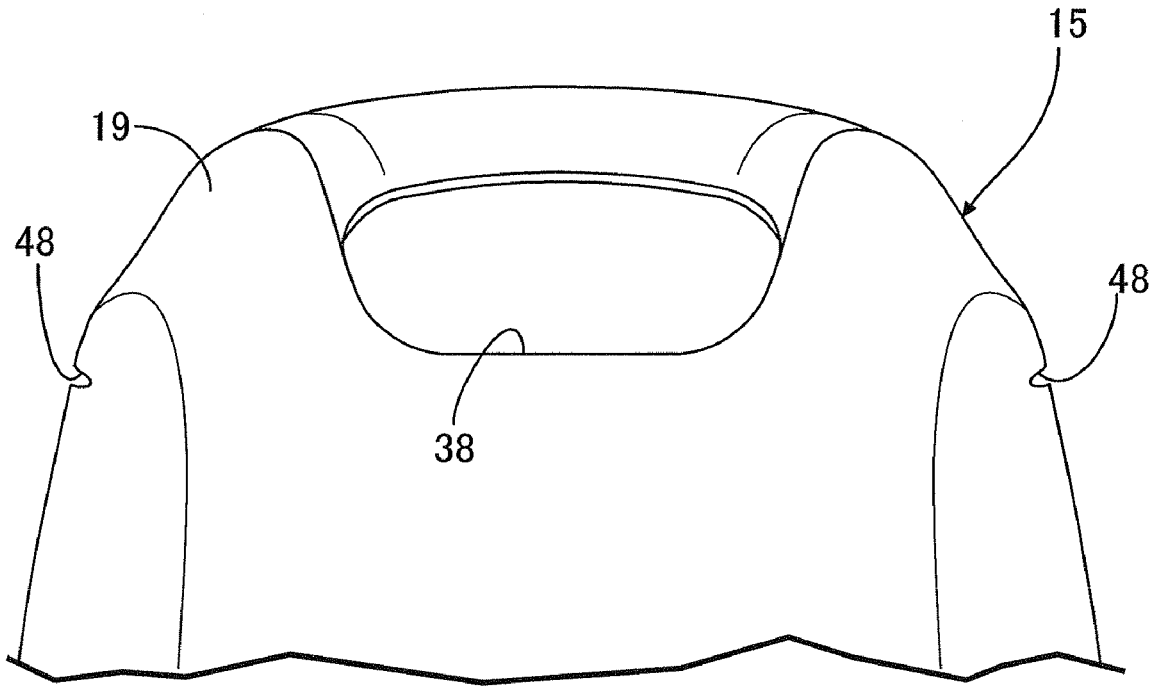
FIG. 5 is a rear view from arrow 5 in FIG. 4.
Figure 6:
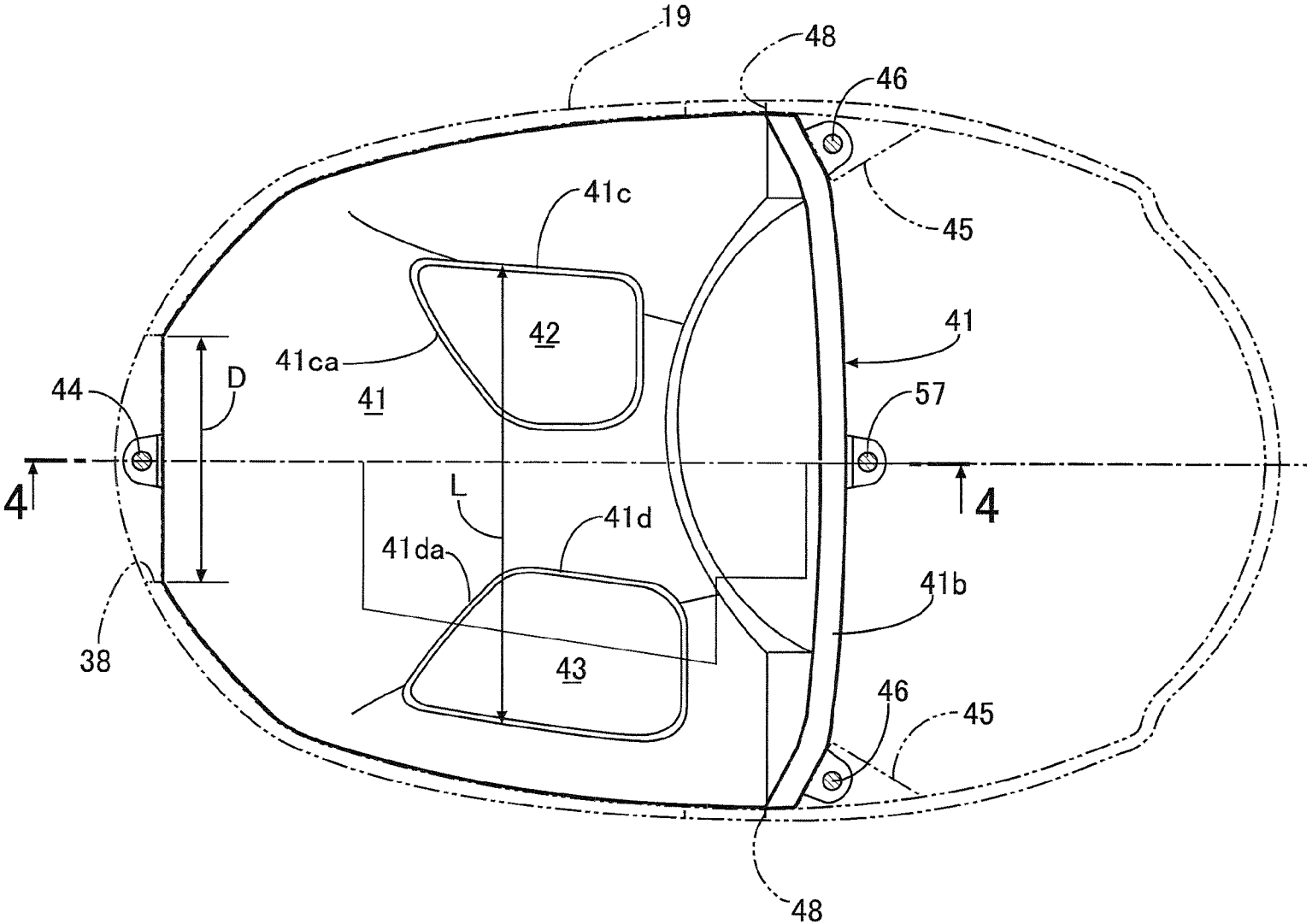
FIG. 6 is a cross-sectional view taken along line 6-6 in FIG. 4.

In FIGS. 4-6, the upper cover 19 of the engine cover 15 is provided with an intake port 38 that opens on the rear side, and an intake chamber 39 that is disposed above the engine E and is formed to communicate with the intake port 38.

The intake chamber 39 is formed from the upper cover 19 of the engine cover 15 and an internal cover 41 that is mounted on the upper cover 19 from the inside to segregate or separate the intake chamber 39 from an engine compartment 40 housing the engine E.

The internal cover 41 is formed from a synthetic resin and is integrally provided with a bottom plate portion 41*a*, a front wall portion 41*b*, and a pair of tubular portions 41*c* and 41*d*. The bottom plate portion 41*a* faces an inner face of the upper part of the upper cover 19 and has a rear edge part and two side edge parts connected to the inner face of the upper part of the upper cover 19. The front wall portion 41*b* extends upward from a front edge of the bottom plate portion 41*a* and is connected to the inner face of the upper part of the upper cover 19. The tubular portions 41*c* and 41*d* form passage holes 42 and 43 which provide communication between the intake chamber 39 and the interior of the engine compartment 40, and extend upward from the bottom plate portion 41*a*. A central region of a rear part of the bottom plate portion 41*a* is secured, via a screw member 44, to the upper cover 19 below the intake port 38. Opposite sides of a front part of the bottom plate portion 41*a* are secured, via screw members 46, to a pair of mounting bosses 45 provided integrally with the inner face of the upper cover 19. The center of the upper end of the front wall portion 41*b* is secured to the inner face of the upper part of the upper cover 19 by a screw member 47.

The tubular portions 41*c* and 41*d* are arranged side by side in a left-to-right direction so water that has entered the intake chamber 39 via the intake port 38 passes through the tubular portions 41*c* and 41*d*. A pair of drain holes 48 and 48, which discharge water that has branched to the left and right after abutting against the front wall portion 41*b* within the intake chamber 39, are formed in the left and right sides of the upper cover 19 and communicate with the left and right frontal parts within the intake chamber 39.

Moreover, a width D, in a left-to-right direction, of the intake port 38 is smaller than a distance L between outer ends of the tubular portions 41*c* and 41*d* in the left-to-right direction. Side walls 41*ca* and 41*da*, which face the intake port 38 of the tubular portions 41*c* and 41*d*, are inclined so that they approach each other in a forward direction.

Furthermore, the bottom plate portion 41*a* inclines upward toward the front wall portion 41*b* from the intake port 38, while the front wall portion 41*b* inclines upward to the front while curving convexly to the rear.

The operation of the invention will now be explained. The engine cover 15 covering the engine E is formed from the lower cover 18 fixed to the casing 11 and the upper cover 19 joined to the lower cover 18 via the first mating surface 20. The linear member lead-out part 25 is formed from the case part 27 and is integrally connected to the lower cover 18 and projects forward from the front wall of the lower cover 18. The lid member 28 is joined to the case part 27 via the second mating surface 29 disposed below the first mating surface 20. The water entrance chamber 34, which is formed in the lower cover 18 so that front and rear walls thereof are defined by the connecting wall portion 31 and the extended wall portion 18*a* provided integrally with the lower cover 18 while being spaced in the fore-and-aft direction, is disposed among left and right sides of the linear member lead-out part 25 on the side on which a small gap is formed between the lid member 28 and the lower cover 18. It is therefore possible to minimize the amount of water entering into the engine cover 15 by temporarily receiving, via the water entrance chamber 34, water that is about to enter the engine cover 15 through the small gap between the lid member 28 and the lower cover 18 when the outboard motor is operating in turbulent waters. Moreover, the connecting wall portion 31 and the extended wall portion 18*a* are integrally provided with the lower cover 18. As such, it is possible to minimize the water from entering the engine cover 15 by using a simple structure while preventing any increase in the number of components.

Moreover, since the drain hole 35 is provided in the lower cover 18 and defines an opening in the bottom part of the water entrance chamber 34, water that has entered the water entrance chamber 34 is effectively discharged to the exterior through the drain hole 35. Subsequently, water does not accumulate in the water entrance chamber 34, and it is possible to more reliably prevent water from entering the engine cover 15.

Furthermore, the intake chamber 39 is formed from the upper cover 19 of the engine cover 15 and the internal cover 41 mounted on the upper cover 19 to segregate the engine compartment 40 from the intake chamber 39. The internal cover 41 integrally has the bottom plate portion 41*a* facing the inner face of the upper part of the upper cover 19, a rear edge part and two side edge parts connected to the inner face of the upper part of the upper cover 19, the front wall portion 41*b* extending upward from the front edge of the bottom plate portion 41*a* and connected to the inner face of the upper part of the upper cover 19, and the pair of tubular portions 41*c* and 41*d* extending upward from the bottom plate portion 41*a* while forming the passage holes 42 and 43, which provides communication between the intake chamber 39 and the interior of the engine compartment 40. The tubular portions 41*c* and 41*d* are arranged side by side in the left-to-right direction so water that enters the intake chamber 39 via the intake port 38 passes through the tubular portions 41*c* and 41*d*. The pair of drain holes 48, which discharge water, are formed on left and right sides of the upper cover 19 while communicating with the left and right front parts of the intake chamber 39.

Water that has entered the intake chamber 39 via the intake port 38 reaches the front wall portion 41*b* by passing through the pair of tubular portions 41*c* and 41*d*, branches to the left and right after abutting against the front wall portion 41*b*, and is discharged from the outboard motor to the exterior via the drain holes 48. As such, even if a large amount of water suddenly enters the intake chamber 39 through the intake port 38, the water is efficiently discharged via the drain holes 48 on opposite sides. It is therefore possible to effectively prevent water from entering the engine compartment 40 via the intake chamber 39. Moreover, it is possible to prevent water from entering the engine compartment 40 using a uniquely configured and simplified shape of the internal cover 41 mounted, from the inside, on the upper cover 19 of the engine cover 15.

Furthermore, since the width D in the left-to-right direction of the intake port 38 is smaller than the distance L between the outer ends of the two tubular portions 41*c* and 41*d* in the left-to-right direction, water that has entered the intake chamber 39 via the intake port 38 is effectively guided between the pair of tubular portions 41*c* and 41*d*. Also, since the side walls 41*ca* and 41*da* of the tubular portions 41*c* and 41*d*, which face the intake port 38, are formed in an inclined manner, water that has entered the intake chamber 39 via the intake port 38 is effectively guided through the pair of tubular portions 41*c* and 41*d*.

Moreover, since the bottom plate portion 41*a* is formed to incline upward toward the front wall portion 41*b* from the intake port 38, the discharge of water from the intake chamber 39 is effectively carried out by returning water that has entered the intake chamber 39 to the intake port 38 side.

Although a preferred embodiment of the present invention is explained above, the present invention is not limited to the above-mentioned embodiment and may be modified in a variety of ways as long as the modifications do not depart from the spirit and scope of the present invention described in the appended claims.

What is claimed is:

1. An outboard motor intake port system comprising:

a vertically extending casing;

an engine mounted on an upper part of the casing;

an engine cover covering the engine and having, in an upper part thereof, an intake port opening on a rear side; and an intake chamber formed within the engine cover, being disposed above the engine, and communicating with the intake port, the intake chamber comprising the engine cover and an internal cover mounted to an inner face of the engine cover to segregate the intake chamber from an engine compartment housing the engine, the internal cover comprising:

a bottom plate portion facing the inner face of the engine cover and having a rear edge part and two side edge parts connected to the inner face of the engine cover;

a front wall portion extending upward from the front edge of the bottom plate portion and being connected to the inner face of the engine cover; and a pair of tubular portions extending upward from the bottom plate portion while forming passage holes providing communication between the intake chamber and the interior of the engine compartment, wherein the two tubular portions are arranged side-by-side in the left-to-right direction so that water that has entered the intake chamber via the intake port passes through the pair of tubular portions, and wherein a pair of drain holes for discharging water are formed in the engine cover and communicate with left and right front parts of the intake chamber.

2. The outboard motor intake port system according to claim 1, wherein a width, in a left-to-right direction, of the intake port is less than a distance between outer ends of the pair of tubular portions in the left-to-right direction.

3. The outboard motor intake port system according to claim 1, wherein the bottom plate portion inclines upward from the intake port toward the front wall portion.

4. The outboard motor intake port system according to claim 2, wherein the bottom plate portion inclines upward from the intake port toward the front wall portion.

5. The outboard motor intake port system according to claim 1, wherein side walls of the pair of tubular portions face the intake port and are formed in an inclined manner to approach each other in a forward direction.

6. The outboard motor intake port system according to claim 2, wherein side walls of the pair of tubular portions face the intake port and are formed in an inclined manner to approach each other in a forward direction.

7. The outboard motor intake port system according to claim 3, wherein side walls of the pair of tubular portions face the intake port and are formed in an inclined manner to approach each other in a forward direction.

8. The outboard motor intake port system according to claim 4, wherein side walls of the pair of tubular portions face the intake port and are formed in an inclined manner to approach each other in a forward direction.

* * * * *